US006390776B1

(12) United States Patent
Gruenwald

(10) Patent No.: US 6,390,776 B1
(45) Date of Patent: May 21, 2002

(54) MARINE PROPELLER

(76) Inventor: David Gruenwald, 2615 NE. 5$^{th}$Ave., Pompano Beach, FL (US) 33064

( * ) Notice: Subject to any disclaimer, the term of this patent is extended or adjusted under 35 U.S.C. 154(b) by 0 days.

(21) Appl. No.: 09/539,993

(22) Filed: Mar. 30, 2000

(51) Int. Cl.$^{7}$ ..... B63H 1/26

(52) U.S. Cl. ..... 416/203; 416/244 B; 416/247 A; 416/235

(58) Field of Search ..... 416/203, 244 B, 416/247 A, 237, 235, 204 R, 242; 440/49

(56) References Cited

U.S. PATENT DOCUMENTS 746,007 A * 12/1903 Bruncker ..... 416/203
2,222,444 A * 11/1940 Schmidt et al. ..... 416/203
2,396,811 A * 3/1946 Bathras ..... 416/242
3,791,762 A * 2/1974 Brehme ..... 416/198 R
4,729,714 A * 3/1988 Wrobel ..... 416/203
5,290,147 A * 3/1994 Karls et al. ..... 416/137
5,791,874 A * 8/1998 Lang ..... 416/235

* cited by examiner

*Primary Examiner*—F. Daniel Lopez
*Assistant Examiner*—Richard Woo
(74) *Attorney, Agent, or Firm*—McHale & Slavin

(57) ABSTRACT

A marine propeller with increased performance in reverse has a hub and a multiplicity of blades extending radially outward. A portion of the trailing edges of some or all of the blades are modified to lessen interference between blades and increase the bite of those blades when operated in reverse.

10 Claims, 2 Drawing Sheets

MARINE PROPELLER

FIELD OF THE INVENTION

This invention is directed to the marine industry and in particular to multi-blade propellers.

BACKGROUND OF THE INVENTION

The propulsion system on a boat is one of the most important aspects of boat design, yet least understood. There are variety of items that make up the propulsion system and numerous items that affect how well the propulsion system works.

The propeller remains the most critical aspect of the propulsion system. Shaft angle, boat trim, stern gear, boat weight, engine horsepower and gear ratio are but a few items that affect propeller performance and behavior.

A major concern of propeller design is the amount of vibration that the propeller will produce while under way. As a general rule, in order to minimize vibration the number of blades on the propeller should be increased. There is no particular limit to the number of blades a propeller may have however, costs increase with the number of blades while the gain in reduction of vibration decreases with each additional blade. A negative consequence of increasing the number of blades on the propeller is the progressive reduction of efficiency of the propeller while operating in reverse to back down the boat.

Another major concern in propeller design is cavitation. One of the most unpredictable conditions that affects propeller operation is cavitation. Cavitation is a partial vacuum caused by excessive propeller speed or loading. The vacuum causes bubbles to form and implode irregularly causing uneven pressure on both sides of the blades resulting in vibration that feels like an unbalanced or unequally pitched blades. Further, the force of imploding bubbles can actually pull materials off the surface of the propeller leading to pitting, uneven wear, and resulting in bad balance and additional vibration.

On higher speed vessels, those operating over 40 knots, shaft rpms frequently force the propellers into a condition that some cavitation is difficult to avoid. For this reason super cavitating propellers have been developed that are capable of operating at high speeds without cavitation. These high speed propellers have blades shaped so that the low pressure side of the blade where cavitation forms, is vented to the atmosphere making cavitation almost impossible. The super cavitating propellers, commonly referred to as surface piercing propellers, were typically found only on high speed boats.

The surface piercing propellers are designed to work when partially submerged, e.g. about half in and half out of the water. Typically, such propellers are mounted aft of the transom except in cases like Small U.S. Pat. No. 4,689,026 where the propeller operates in a tunnel.

A disadvantage to these types of propellers is their inability to provide sufficient reversing thrust. The blade shape required for high efficiency at speed in a super cavitating design inhibits reversing properties that are normal to the typical propeller. This is caused by two factors. First, the blade has a progressive pitch which means that the pitch gets progressively higher as it approaches the trailing edge of the blade. When used in reverse, the trailing edge has too much pitch for efficient operation. Second, the trailing edge of a super cavitating propeller is sharp because, in forward, it is desired to have the flow of water separate from the blade efficiently. While required in forward, this sharp trailing edge becomes the leading edge in reverse and, as such, degrades reverse thrust by causing a ventilation bubble. If the blades are close together, the bubble from one blade can extend to the adjacent blade causing a total loss in reverse thrust. Yet a high number of blades is desired to minimize vibration so an inherent design conflict exists.

Thus what is lacking in the art is a multi-blade propeller having a shape that does not affect forward performance yet allows reversing properties similar to those of a conventional propeller.

SUMMARY OF THE INVENTION

The instant invention is directed toward a marine propeller with increased performance in reverse but without decreased performance in forward, having a hub and a multiplicity of blades extending radially outward from the hub. The separation of these blades about the hub lessens interference between the blades and increases the efficiency of the propeller. Interference between adjacent blades may be reduced by decreasing the number of blades or increasing the length of certain blades beyond the length of other blades or increasing the diameter of certain blades beyond the diameter of other blades.

Accordingly, it is an object of this invention to provide a multi-blade propeller with improved performance for backing down a boat.

It is a further object of this invention to decrease the interference of each propeller blade with the performance of the blades directly adjacent to it while operating in reverse.

Another object of this invention is to provide multi-blade propellers with a portion of the trailing edge of some of the blades further aft than the trailing edges of the other blades.

It is a further object of this invention to provide a propeller with blades having different widths.

It is a further object of this invention to provide a propeller with a modified trailing edge.

It is a further object of this invention to provide the trailing edge of the blades with a shallow concavity.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
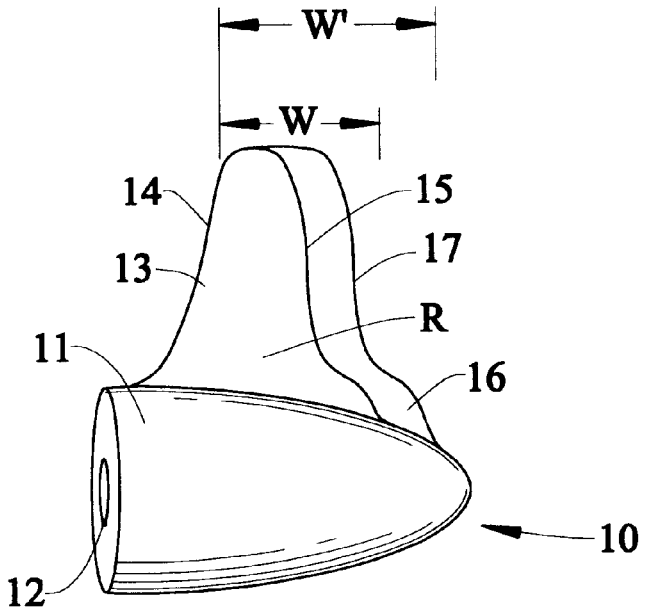
FIG. 1 shows a partial elevation of a propeller having blades of differing widths.

In FIG. 1 a boat propeller 10 is shown with only two blades for simplicity. Also, the blades are shown without pitch so they appear flat. These propellers may be made with any number of blades on a hub. The blades of these multi-blade propellers are disposed symmetrically about the hub, for example, the blades of a four bladed propeller are ninety degrees apart and a ten blade propeller has blades 36 degrees apart. The forward end of hub 11 has a keyway 12 into which a drive shaft (not shown) is fitted. The drive shaft transmits the power from the engine(s) to the propeller. The blade 13 has a leading edge 14 and trailing edge 15. The trailing edge 15 intersects the leading edge 14 defining the blade surface. The length of the blade is determined as the distance from hub to the point where the leading edge and trailing edge intersect. The width of the blade is determined as the distance from the leading edge to the trailing edge at a fixed radius from the hub. The chord of the blade is, in general, the thickness of the blade at its thickest point.

During rotation, the blades of the propeller have a high pressure side and a low pressure side. The high pressure side of the blade is the forward or leading side in the direction of the rotation of the propeller. The low pressure side of the blade is the following or back side. The blades of the propeller are designed to operate most efficiently in forward gear with the high pressure side leading in the direction of rotation. These considerations, in general, dictate the form of the back side of the blades. However, in reverse, the low pressure side becomes the leading side.

In FIG. 1 and all the other Figures, the surface R of the blades is the low pressure side and initially contacts the water in reverse. This denotes a rotation of the blades, in reverse, toward the viewer of the Figures.

The blade 16 has a leading edge (not shown) which is shaped identically with leading edge 14 and extends from the hub in the same plane as the leading edge 14. Blade 16 has a trailing edge 17. Blades 13 and 16 have the same profile in length and chord. Blade 13 has a width w which is less than the width w' of blade 16.

While FIG. 1 shows the blades 13 and 16 as being adjacent, in practice, not every adjacent blade must have a different width. For example, a propeller with eight blades may have four alternating blades with one width and the other four blades with a greater width while a propeller with nine blades may only have three blades with a greater width than the others. The only prerequisite is that the propeller must remain balanced.

When the propeller of FIG. 1 is turned in reverse, the trailing edge 17 and any other blade with a greater width w' cuts into undisturbed water because the blade which preceded it is now behind it in the axial direction. The ventilation bubble created by each wider blade is separated from the next wider blade by the number of intervening blades. Since the interference on the wider blades is reduced, the propeller becomes more efficient in reverse.

Figure 2:
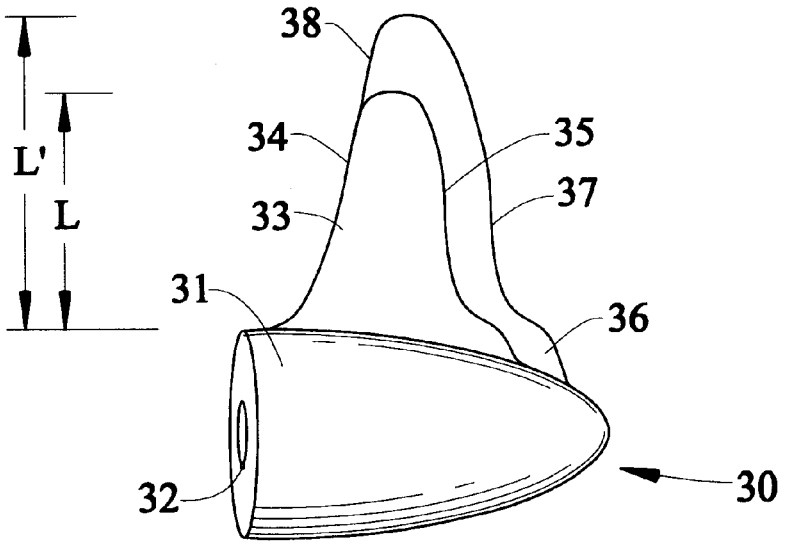
FIG. 2 shows a partial elevation of a propeller having blades with different diameter on the same hub.

In FIG. 2 propeller 30 has hub 31 with a keyway 32. Blade 33 has a leading edge 34, a trailing edge 35 and a length L. Leading edge 38 of blade 36 extends from the hub 31 in the same plane as the leading edge 34 of blade 33. Blade 36 has a trailing edge 37, a leading edge 38 and a length L'. In FIG. 2, blade 36 has a greater length than blade 33. Blade 36 and blade 33 can have the same profile in width and chord or they can have different width and chord as shown. As stated above, the blades shown in the FIG. 2 are adjacent but in practice there can be a number of blades interposed between the longer and/or wider blades.

Figure 3:
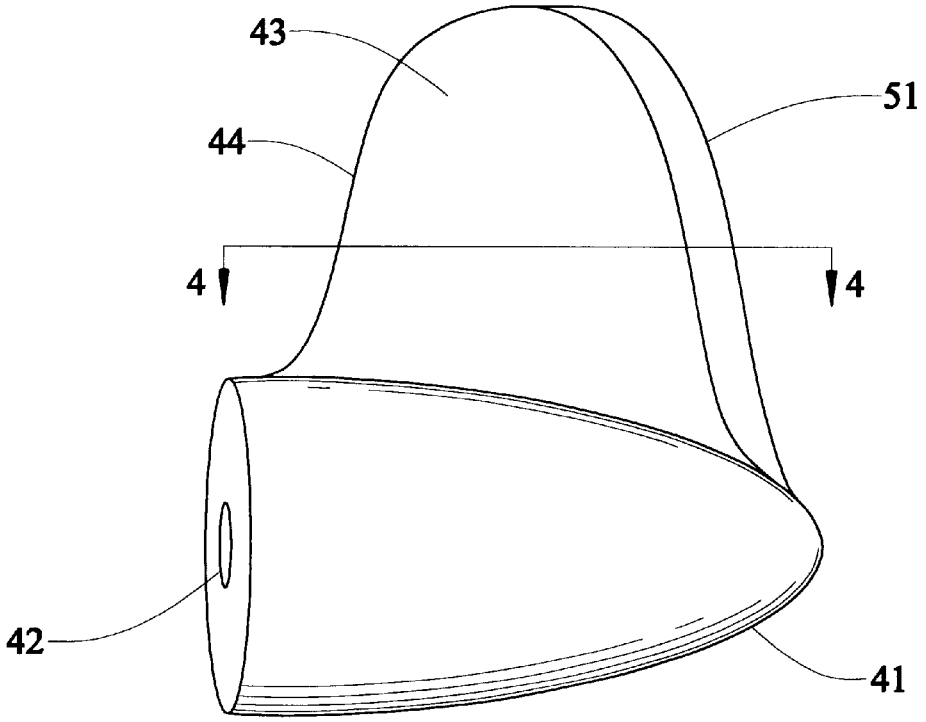
FIG. 3 shows a partial elevation of a propeller having blades with a modified trailing edge.
Figure 4:
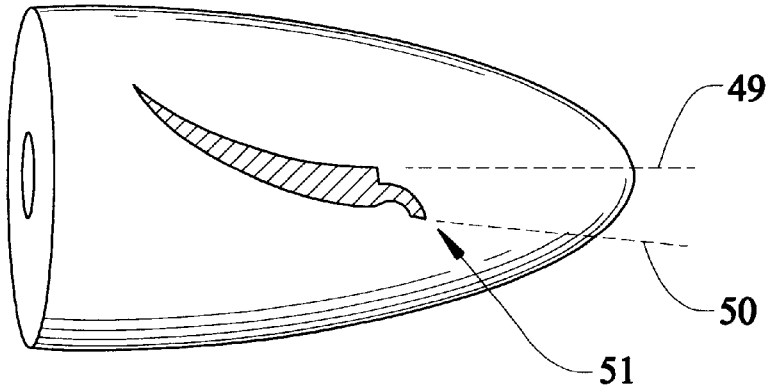
FIG. 4 shows a cross section of a modified blade along line 4—4 of FIG. 3.

In the embodiments shown in FIG. 3, the modification to the blades to increase reverse efficiency is on the trailing edge of the propeller blade. The trailing edge modification is kept inside an imaginary extension of the high pressure surface 49 and an imaginary extension of the low pressure side of the blade 50 (shown in FIG. 4). In this manner, the modifications do not affect the propeller operation in forward motion.

FIG. 3 shows a marine propeller with a hub 41, a keyway 42, and blades 43. The blades 43 have the same profile in width, length and chord. The leading edges 44 of the blades extend from the hub in the same plane. The trailing edge of blades 43 have an addendum 51, shown in FIG. 4, which extends further aft on what would normally be a flat surface in the case of a "cleaver" type super cavitating propeller. In reverse, the modified blades with the addendum 51 or radius 48 to smooth the flow of water in the reverse direction of rotation reduce the tendency to form a ventilation or cavitation bubble on the low pressure side of the blade because the water is flowing around a smooth radius 48 rather than a sharp edge, thereby increasing the bite of the modified blades. As stated above, the blade with the addendum or radius may be on every blade, on alternate blades or on any combination of blades as long as the entire propeller remains balanced.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. A marine propeller for providing forward motion when rotating in one direction and reverse motion when rotating in the opposite direction comprising a hub having a forward end and an aft end with a multiplicity of blades extending radially outwardly therefrom, each of said blades having a leading edge terminating on said hub near said forward end and a trailing edge terminating on said hub near said aft end, said leading edge and said trailing edge circumscribing the blade surface wherein said trailing edge of said some of said multiplicity of blades has an addendum on said trailing edge, said addendum formed as a radius which smooths the flow of water across said trailing edge when said propeller is rotating in the opposite direction.

2. A marine propeller of claim 1 wherein said trailing edges of said some of said blades having said addendum are disposed symmetrically about said hub.

3. A marine propeller of claim 1 wherein said trailing edge of said some of said blades having a radius terminates in a curve toward said opposite direction.

4. A marine propeller of claim 1 wherein some of said multiplicity of blades have a greater blade surface than some other of said multiplicity of said blades.

5. In a super cavitating marine propeller for providing forward motion when rotating in one direction and reverse motion when rotating in the opposite direction wherein the adjacent blades tend to interfere with each other degrading reverse motion, the propeller having a hub with a forward end, an aft end and a multiplicity of adjacent blades extending radially outwardly from said hub, said adjacent blades disposed symmetrically about the circumference of said hub, said adjacent blades having a leading edge and a trailing edge, said blades having a length and a width, the improvement comprising some of said multiplicity of said adjacent blades having a greater width with a portion of said trailing edges terminating further aft than said trailing edges of the other blades so as not to interfere with said adjacent blades when rotating in the opposite direction, said some of said blades disposed symmetrically about said circumference of said hub.

6. A super cavitating marine propeller of claim 5 wherein said some of said adjacent blades has an addendum on said trailing edge.

7. A super cavitating marine propeller of claim 6 wherein said some of said adjacent blades having an addendum are adjacent said some of said blades having a greater width, said some of said adjacent blades having an addendum disposed symmetrically about said circumference of said hub.

8. In a super cavitating marine propeller for providing forward motion when rotating in one direction and reverse motion when rotating in the opposite direction wherein the adjacent blades tend to interfere with each other degrading reverse motion, the propeller having a hub with a forward end, an aft end and a multiplicity of adjacent blades extending radially outwardly from said hub, said adjacent blades disposed symmetrically about the circumference of said hub, said adjacent blades having a leading edge and a trailing edge, the improvement comprising some of said multiplicity of said adjacent blades have a greater length with a portion of said trailing edges terminating further radially than said trailing edges of the said adjacent blades so as not to interfere with said adjacent blades when rotating in the opposite direction, said some of said adjacent blades disposed symmetrically about said circumference of said hub.

9. In a super cavitating marine propeller of claim 8 wherein said some of said adjacent blades have an addendum on said trailing edge.

10. In a super cavitating marine propeller of claim 9 wherein said some of said adjacent blades having an addendum are adjacent said some of said blades having a greater length, said some of said blades having an addendum disposed symmetrically about the circumference of said hub.

* * * * *